US008992174B2

(12) United States Patent
Chang

(10) Patent No.: US 8,992,174 B2
(45) Date of Patent: Mar. 31, 2015

(54) FAN ASSEMBLY

(75) Inventor: Shun-Chen Chang, Taoyuan Hsien (TW)

(73) Assignee: Delta Electronics, Inc., Taoyuan (TW)

( * ) Notice: Subject to any disclaimer, the term of this patent is extended or adjusted under 35 U.S.C. 154(b) by 891 days.

(21) Appl. No.: 13/206,371

(22) Filed: Aug. 9, 2011

(65) Prior Publication Data

US 2012/0189439 A1 Jul. 26, 2012

(30) Foreign Application Priority Data

Jan. 25, 2011 (TW) ..... 100102548 A

(51) Int. Cl.
*F03D 1/04* (2006.01)
*F04D 25/08* (2006.01)
*F04F 5/16* (2006.01)

(52) U.S. Cl.
CPC .. *F04D 25/08* (2013.01); *F04F 5/16* (2013.01)
USPC ..... 415/206; 415/211.2; 415/224.5; 415/226

(58) Field of Classification Search
USPC ..... 415/212.1, 211.2, 220, 219.1, 218.1, 415/222, 224, 224.5, 226, 203, 204, 206, 415/207, 182.1
See application file for complete search history.

(56) References Cited

U.S. PATENT DOCUMENTS 2,488,467 A * 11/1949 De Lisio Salvatore ..... 239/561
2009/0060710 A1 3/2009 Gammack et al.

FOREIGN PATENT DOCUMENTS

CN 101936310 * 1/2011 ..... F04F 5/16
DE 1291090 * 3/1969 ..... F04D 25/08

* cited by examiner

*Primary Examiner* — Edward Look
*Assistant Examiner* — Juan G Flores
(74) *Attorney, Agent, or Firm* — Muncy, Geissler, Olds & Lowe, P.C.

(57) ABSTRACT

A fan assembly includes a channel structure and a centrifugal fan. The channel structure includes a housing and at least a slit. The housing has an accommodating space and a flow channel adjacent to each other. The slit is extended along the flow channel. The flow channel is communicated with the outside of the housing via the slit. The centrifugal fan is disposed in the accommodating space. The centrifugal fan draws air along an axial direction and generates an airflow. The airflow flows into the flow channel along a radial direction, and flows out to the outside of the housing via the slit.

34 Claims, 11 Drawing Sheets

FAN ASSEMBLY

CROSS-REFERENCE TO RELATED APPLICATIONS

This Application claims priority of Taiwan Patent Application No. 100102548, filed on Jan. 25, 2011, the entirety of which is incorporated by reference herein.

BACKGROUND OF THE INVENTION

1. Field of the Invention

The invention relates to a fan assembly, and in particular, to a fan assembly utilizing a centrifugal fan to generate an airflow to a channel structure, wherein the airflow flows out from the channel structure.

2. Description of the Related Art

A conventional household fan utilizes a motor to drive an axial-flow fan to rotate, and then an airflow is generated by the rotating axial-flow fan. The household fan has large blades to generate enough airflow. However, the larger blades have greater torque, and an extending direction and a rotating direction of the blade have an acute angle therebetween. Thus, it is very dangerous; especially if children touch the rotating blades.

To solve the above problem, US Patent App. publication No. 20090060710 discloses a fan 100 as shown in FIG. 1. An axial-flow fan 110 is disposed in a base 120, and air is drawn via an air inlet 121 of the side wall of the base 120. The air flows into an annular nozzle 130 along a flow path F1. Finally, the air flows out from the annular nozzle 130 and is discharged at the inner side of the annular nozzle 130 to flow along a flow direction D1.

Because the axial-flow fan 110 is disposed in the base 120, children cannot touch the axial-flow fan 110. Moreover, the inner side of the annular nozzle 130 is a hollow space, and thus the annular nozzle 130 will not block light due to the hollow space.

However, the above design has many disadvantages, and thus the exhaust efficiency of the fan 100 is very weak. In FIG. 1, the axial-flow fan 110 draws air along the axial direction and generates airflow along the axial direction. Since the blade of the axial-flow fan 100 is disposed downwardly, and the motor 111 is located between the blade and the annular nozzle 130, the airflow is guided upwardly to the annular nozzle 130. However, all of the components (such as the motor 111) of the axial-flow fan 110 will occupy almost all of the space inside of the base 120, and thus the airflow will flow in a narrow channel G. Thus, the exhaust efficiency is decreased because the airflow is blocked in the narrow channel G. Moreover, the air inlet 121 is disposed on the side wall of the base 120, and the direction of air flowing into the air inlet 121 via the side wall is perpendicular to the intake direction of airflow toward the annular nozzle 130. Thus, the intake efficiency is decreased.

Please also refer to FIG. 2, which is an enlarged view of the part A of FIG. 1. The annular nozzle 130 has an air outlet 132 disposed at the intake side 131, and thus the airflow flowing out from the air outlet 132 will flow from the intake side 131 to the exhaust side 133. In the figures, the airflow is blocked by the annular inner side wall of the annular nozzle 130, and the airflow volume of the air outlet 132 is decreased. Moreover, since the airflow of the annular nozzle 130 flows out from the air outlet 132 after rotation, the wind pressure and the exhaust airflow volume are decreased hugely. Thus, the exhaust efficiency of the fan 100 is decreased.

BRIEF SUMMARY OF THE INVENTION

To solve above problems of the prior art, the object of the invention is to provide a fan assembly. The fan assemble utilizes a centrifugal fan and an improved channel structure to raise the exhaust efficiency and has the advantages of the prior art.

For the above object, an embodiment of the invention provides a fan assembly including a channel structure and a centrifugal fan. The channel structure includes a housing and at least one slit. The housing includes an accommodating space and a flow channel adjacent to each other. The slit is extended along the flow channel, wherein the flow channel is communicated with an outside of the housing via the slit. The centrifugal fan is disposed in the accommodating space, and the centrifugal fan draws air along an axial direction of the centrifugal fan and generates an airflow into the flow channel along a radial direction of the centrifugal fan. The airflow flows out from the slit to the outside of the housing.

In an embodiment, the housing includes at least one air inlet corresponding to the centrifugal fan in the axial direction, and the centrifugal fan draws air from the outside of the housing via the air inlet along the axial direction.

In an embodiment, the channel structure includes at least one guide channel adjacent to the centrifugal fan. The speed of the airflow generated by the centrifugal fan can be increased by the guide channel. The guide channel guides the airflow generated by the centrifugal fan to enter the flow channel along the radial direction.

In an embodiment, the guide channel includes a first guide channel and a second guide channel. The airflow guided by the first guide channel flows along a first direction, and the airflow guided by the second guide channel flows along a second direction. The first direction is different from the second direction.

In an embodiment, the channel structure includes a separator. The first guide channel and the second guide channel are separated by the separator, and the first guide channel and the second guide channel are crossed in the axial direction.

In an embodiment, the channel structure is substantially an annular structure, and the first guide channel guides the airflow to flow into the flow channel of the annular structure along a clockwise direction. The second guide channel guides the airflow to flow into the flow channel of the annular structure along a counter clockwise direction.

In an embodiment, the centrifugal fan includes a motor, a hub, a plurality of first blades and a plurality of second blades. The motor is disposed in the hub. The first blades and the second blades are disposed around the hub corresponding to the first guide channel and the second guide channel, respectively.

In an embodiment, the centrifugal fan further includes a connection element in the shape of a disk. The connection element is connected to the hub and the first and second blades. The connection element is disposed between the first and second blades.

In an embodiment, the centrifugal fan includes a first motor, a first hub, a plurality of first blades, a second motor, a second hub, and a plurality of second blades. The first motor, the first hub and the first blades correspond to the first guide channel. The second motor, the second hub and the second blades correspond to the second guide channel. The first and second motors are disposed in the first and second hubs, respectively. The first and second blades are disposed around the first and second hubs, respectively.

In an embodiment, the first and second motors are separated by the separator.

In an embodiment, the flow channel includes a channel portion and a gradually narrowed terminal portion.

In an embodiment, the terminal portion is gradually narrowed from an end of the terminal portion close to the channel portion to another end of the terminal portion away from the channel portion. The slit is disposed on an edge of the terminal portion away from channel portion.

In an embodiment, the slit is disposed on the channel portion, and the housing has an overlapped part parallel to a flowing direction of the airflow adjacent to the slit.

In an embodiment, the channel structure is substantially an annular structure. An inner side of the annular structure has an air space. The slit is extended around the inner side of the annular structure and the air space.

In an embodiment, the fan assembly further includes a base. The channel structure is supported by the base.

In an embodiment, the centrifugal fan is disposed at an end of the channel structure adjacent to the base, or at another end of the channel structure opposite to the base.

In an embodiment, the channel structure includes a plurality of annular structures. The centrifugal fan is disposed at a connecting portion of the annular structures.

In an embodiment, the channel structure includes an annular structure and a plurality of guide structures. The guide structures are connected to an inner annular surface of the annular structure. The centrifugal fan is disposed on a connecting portion of the guide structure and located at the center of the annular structure.

In an embodiment, the guide structures include a first guide structure along a longitudinal direction and a second guide structure along a transverse direction.

In an embodiment, the channel structure is substantially an annular structure. The annular structure has an air space therein. The air space has an intake side and an exhaust side. When the airflow flows out from the slit to the outside of the housing, air is driven in the air space to move from the intake side to the exhaust side. Moreover, the direction of the airflow flowing out from the slit is the same as the direction of the air moving in the air space.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

Figure 1:
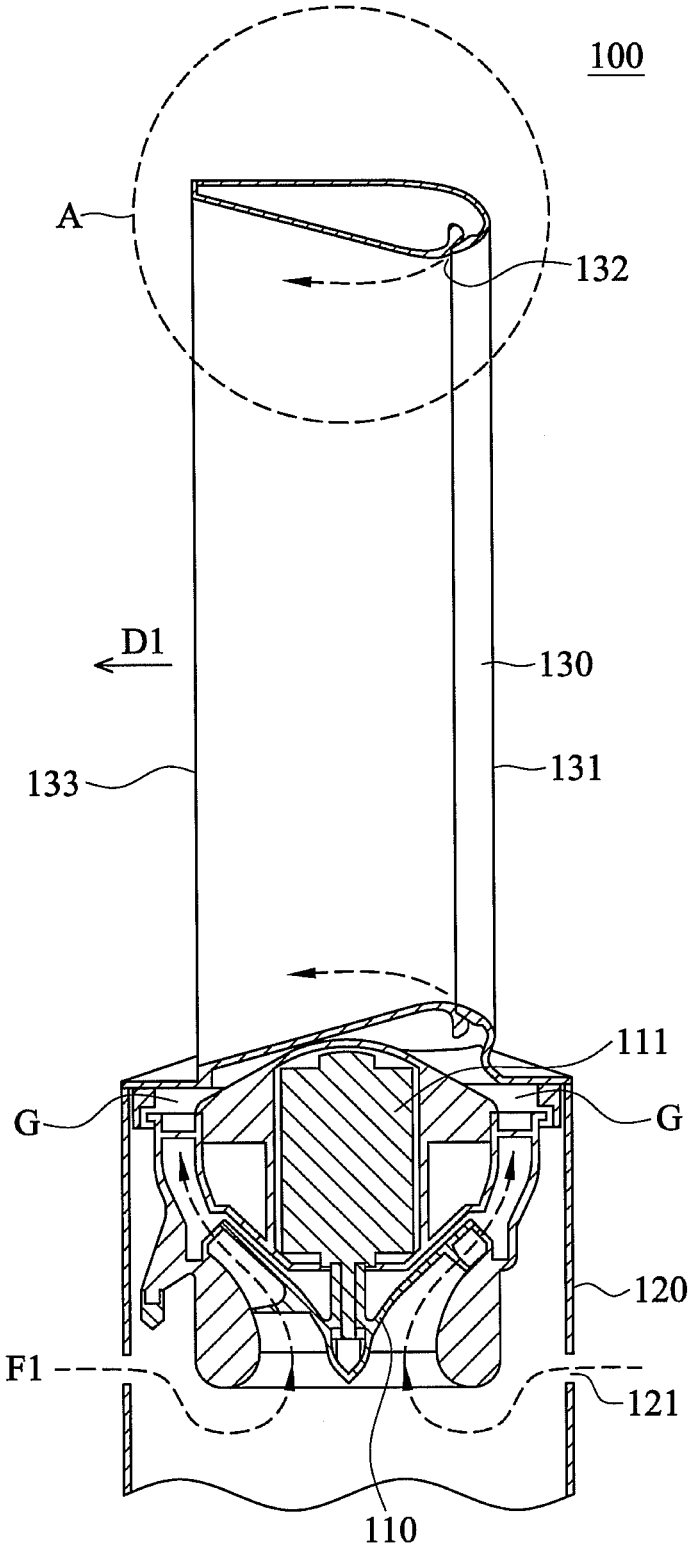
FIG. 1 (PRIOR ART)
FIG. 1 is a cross-sectional view of a conventional fan.
Figure 2:
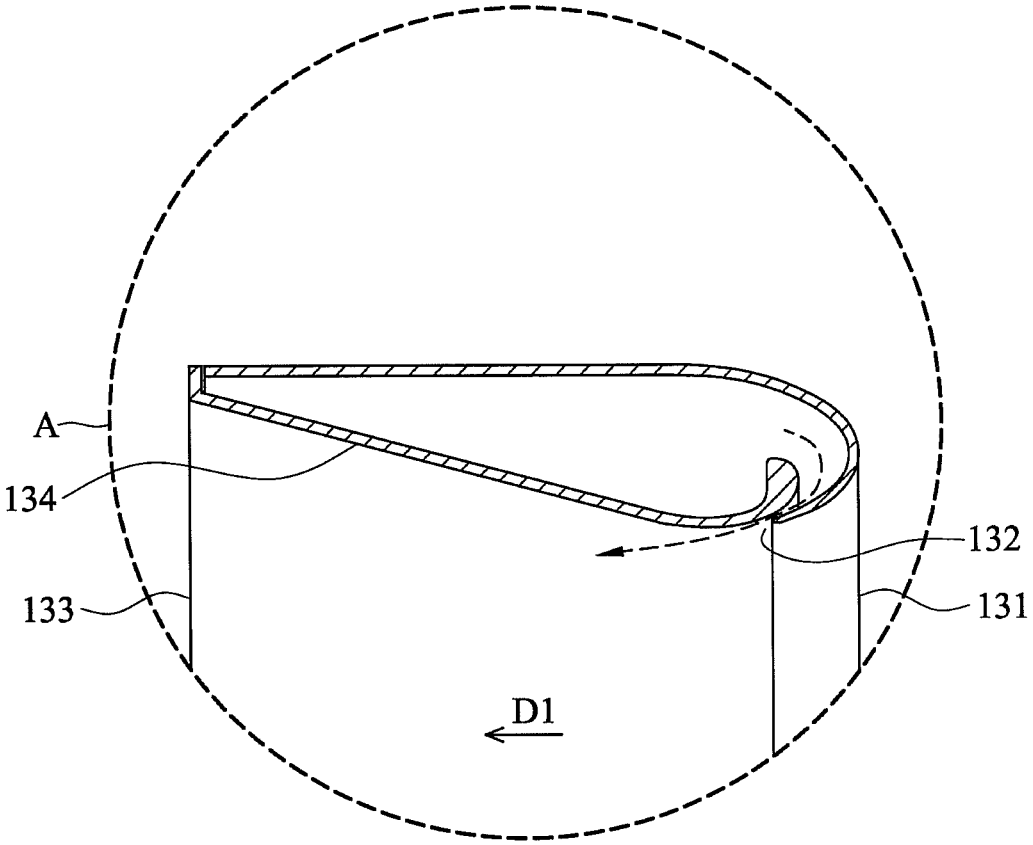
FIG. 2 (PRIOR ART)
FIG. 2 is an enlarged view of the part A of FIG. 1.
Figure 3:
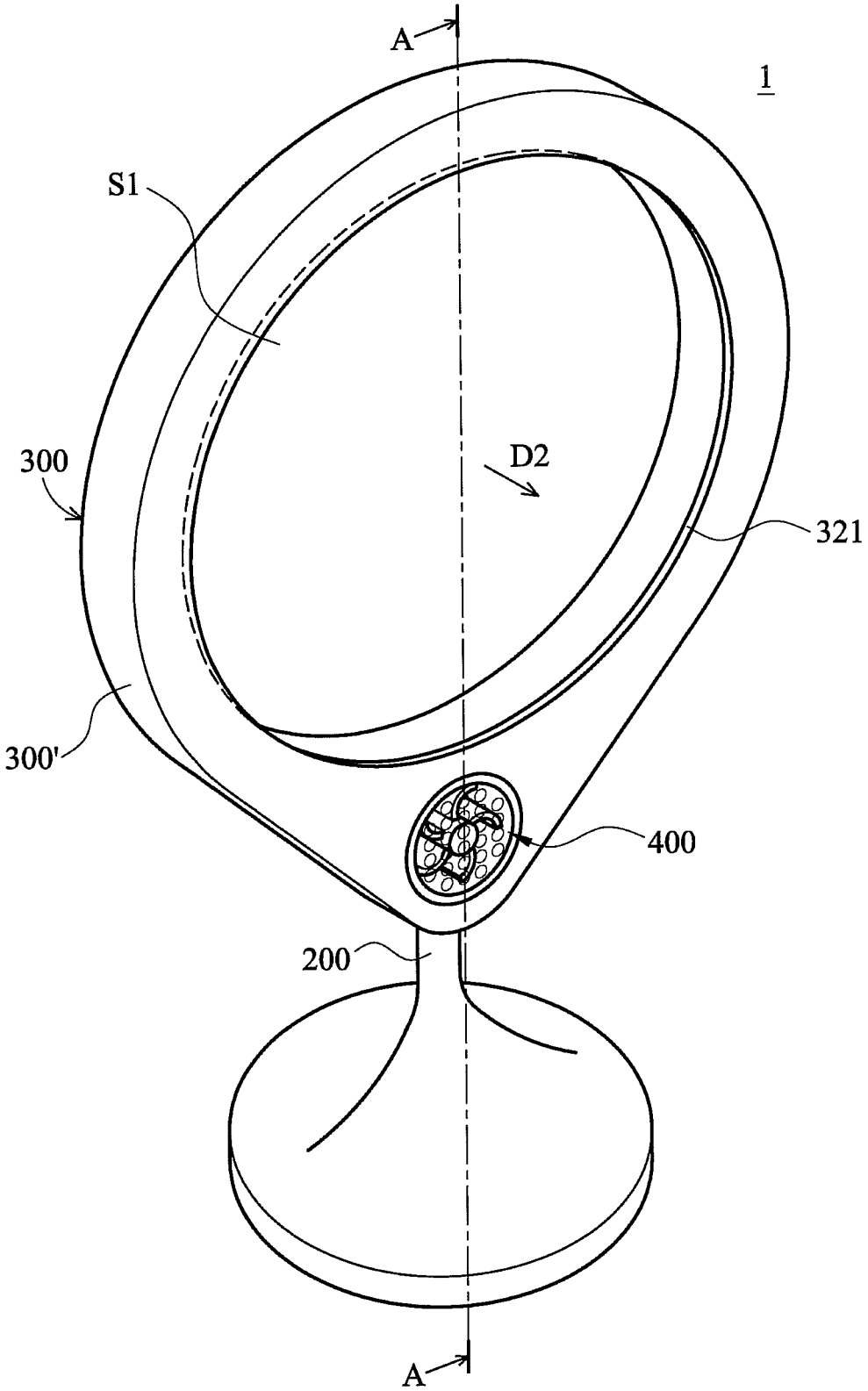
FIG. 3 is a perspective view of a fan assembly of the first embodiment of the invention.
Figure 4:
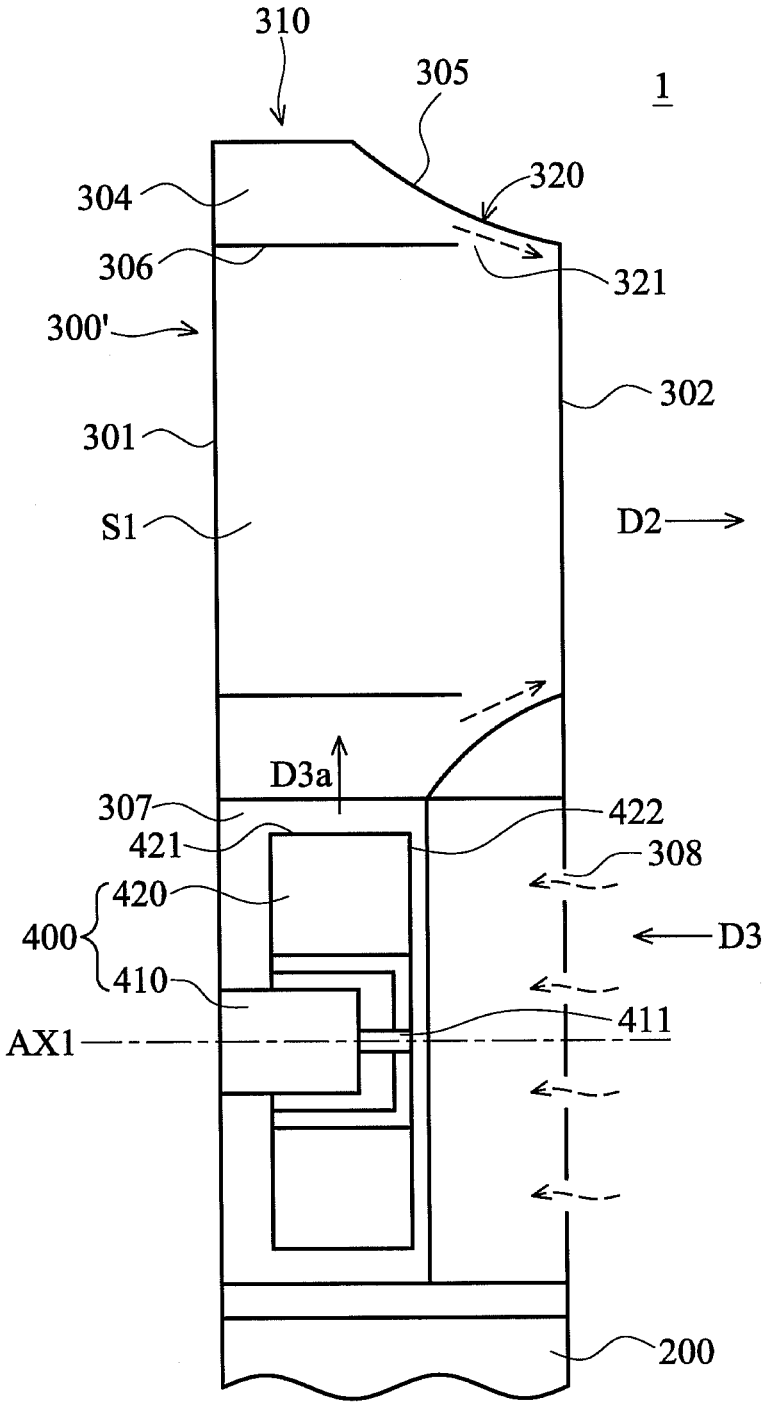
FIG. 4 is a cross-sectional view of a fan assembly of the first embodiment of the invention.

Referring to FIGS. 3 and 4, a fan assembly 1 includes a base 200, a channel structure 300 and a centrifugal fan 400. The base 200 can be disposed on the ground or a table. The channel structure 300 is supported by the base 200. The channel structure 300 includes a housing 300' and at least a slit 321. The housing 300' is a hollow annular structure. The housing 300' has an accommodating space 307 and a flow channel 304 therein. The flow channel 304 and accommodating space 307 are adjacent to each other. The slit 321 is extended along the flow channel 304. The flow channel 304 is communicated with the outside of the housing 300' via the slit 321. The centrifugal fan 400 is disposed in the accommodating space 307. The centrifugal fan 400 draws air along an axial direction D3, and generates an airflow to the flow channel 304 along an radial direction D3*a*. Next, the airflow flows out of the housing 300' via the slit 321.

The housing 300' of the channel structure 300 further includes a plurality of air inlets 308. The accommodating space 307 is communicated with the flow channel 304 and the air inlets 308. The air inlets 308 correspond to the centrifugal fan 400 in the axial direction D3, and the centrifugal fan 400 can draw air from the outside of the housing 300'.

The channel structure 300 is substantially an annular structure. The channel structure 300 has an air space S1 therein. The slit 321 is disposed around the inner side of the annular structure, and the slit 321 encloses the air space S1. The annular structure of the housing 300' has an inner side wall 306, which is adjacent to the flow channel 304, at the inner side of the annular structure. The annular structure has an outer side wall 305 at the outer side of the annular structure. The channel structure 300 is disposed on the base 200. The centrifugal fan 400 is disposed in the channel structure 300 adjacent to an end of the base 200. The airflow generated by the centrifugal fan 400 flows out from the slit 321 of the channel structure 300, and the airflow drives the air in the air space S1 to move from an intake side 301 to an exhaust side 302 along the flow direction D2.

The flow channel 304 has a channel portion 310 and a terminal portion 320. The flow channel 304 is formed in the inside of the channel portion 310 and the terminal portion 320. The channel portion 310 is a U shaped structure and is close to the intake side 301. The terminal portion 320 is close to the exhaust side 302 and connected to the channel portion 310. The terminal portion 320 is a V-shaped structure. The terminal portion 320 is gradually narrowed from the intake side 301 to the exhaust side 302. The cross section of the channel portion 310 is substantially in a rectangular shape. The slit 321 is disposed at an edge of the terminal portion 320 away from the channel portion 310.

When the airflow generated by the centrifugal fan 400 flows to the flow channel 304 in the channel structure 300, the airflow will flow out from the terminal portion 320 or the slit 321 of the channel portion 310. Therefore, the pressure of the airflow is raised, and the air in the air space S1 moves from the intake side 301 to the exhaust side 302. In the embodiment, the airflow between the flow channel 304 and the slit 321 is smooth, and the airflow does not flow to the slit 321 during rotation as the prior art. Therefore, the exhaust airflow volume of the fan assembly is greater.

In the embodiment, the centrifugal fan 400 includes a motor 410 and an impeller 420. The motor 410 and the impeller 420 are disposed in the accommodating space 307. The motor 410 includes a shaft 411 along a rotating axis AX1. The shaft 411 drives the impeller 420 to rotate about the rotating axis AX1. Alternatively, the centrifugal fan 400 includes a fan case (not labeled), and the inside of the fan case is the accommodating space 307.

When the impeller 420 is rotated, the centrifugal fan 400 draws air to the impeller 420 along the axial direction D3, which is parallel to the rotating axis AX1. Then the airflow flows toward the flow channel 304 along the radial direction D3*a*. The radial direction D3*a* is perpendicular to the rotating axis AX1 in the figure. Finally, the airflow flows out from the housing 300' via the slit 321. In FIG. 4, the air inlets 308 correspond to the impeller 420. Namely, the air inlets 308 are arranged in parallel to the inlet surface 422 of the impeller 420. Therefore, when the impeller 420 is rotated, the air is drawn from the air inlets 308 along the axial direction D3 without being blocked by any component. The airflow intake efficiency of the fan assembly 1 is improved compared to the prior art.

Figure 5:
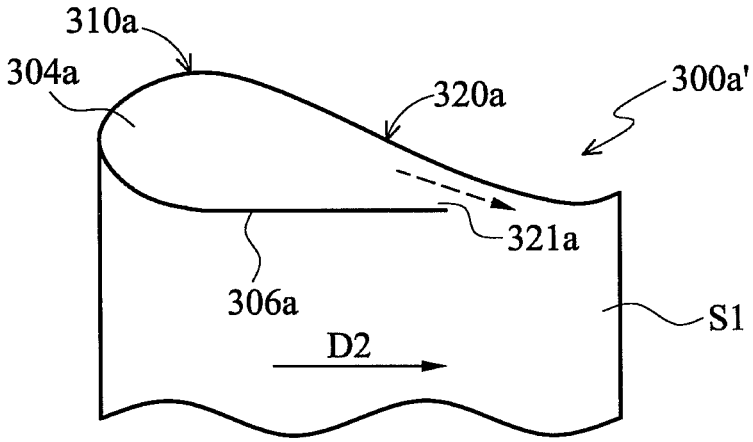
FIG. 5 is a partially cross-sectional view of the channel structure of the second embodiment of the invention.

FIG. 5 is a partially cross-sectional view of the channel structure of the second embodiment of the invention. The difference between the second embodiment and the first embodiment is described below. The cross section of the flow channel 304*a* is in a winged shape. The cross section of a channel portion 310*a* is in an arc shape. The edge of a terminal portion 320*a* is tilted, and the cross section of an inner side wall 306*a* of a housing 300*a*' is extended straightly along a direction that is substantially parallel to the flow direction D2. By the above structure, the airflow flows out from the slit 321*a* more easily, and the air in the air space S1 flows smoothly.

Figure 6:
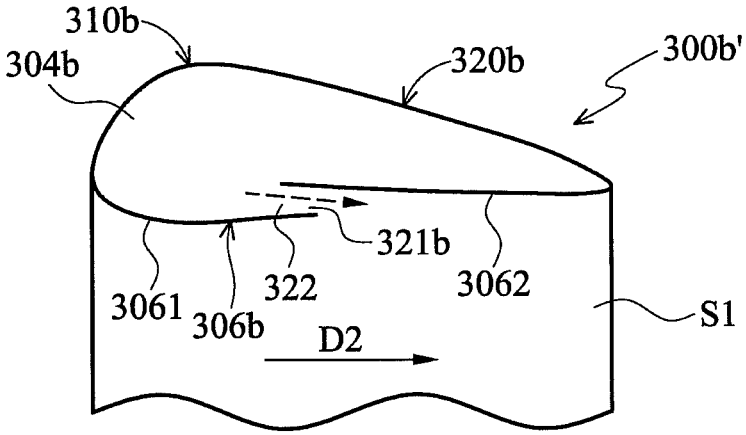
FIG. 6 is a partially cross-sectional view of the channel structure of the third embodiment of the invention.

FIG. 6 is a partially cross-sectional view of the channel structure of the third embodiment of the invention. The difference between the third embodiment and the first embodiment is described below. The cross section of a flow channel 304*b* is in a winged shape. The cross section of a channel portion 310*b* is substantially in an arc shape, and the cross section of a terminal portion 320*b* is in a V shape.

A slit 321*b* is disposed on the channel portion 310. The channel portion 310 further includes a slit channel 322 communicated with the slit 321*b*. The housing 300*b*' has an overlapped part parallel to a flowing direction of the airflow adjacent to the slit 321*b*. The inner side wall 306*b* of the housing 300' includes a first inner wall 3061 and a second inner wall 3062 adjacent to the flow channel 304*b* at the inner side wall 306*b* of the housing 300*b*'. The first inner wall 3061 and the second inner wall 3062 are substantially parallel to the flow direction D2 and overlapped to each other. The overlapped part of the first inner wall 3061 and the second inner wall 3062 forms the slit channel 322, and thus the slit channel 322 is substantially parallel to the flow direction D2. The slit 321*b* is formed at the edge of the slit channel 322. By the above structure, the airflow flows out from the slit 321*b* more easily, and the air in the air space S1 flows more smoothly.

Figure 7:
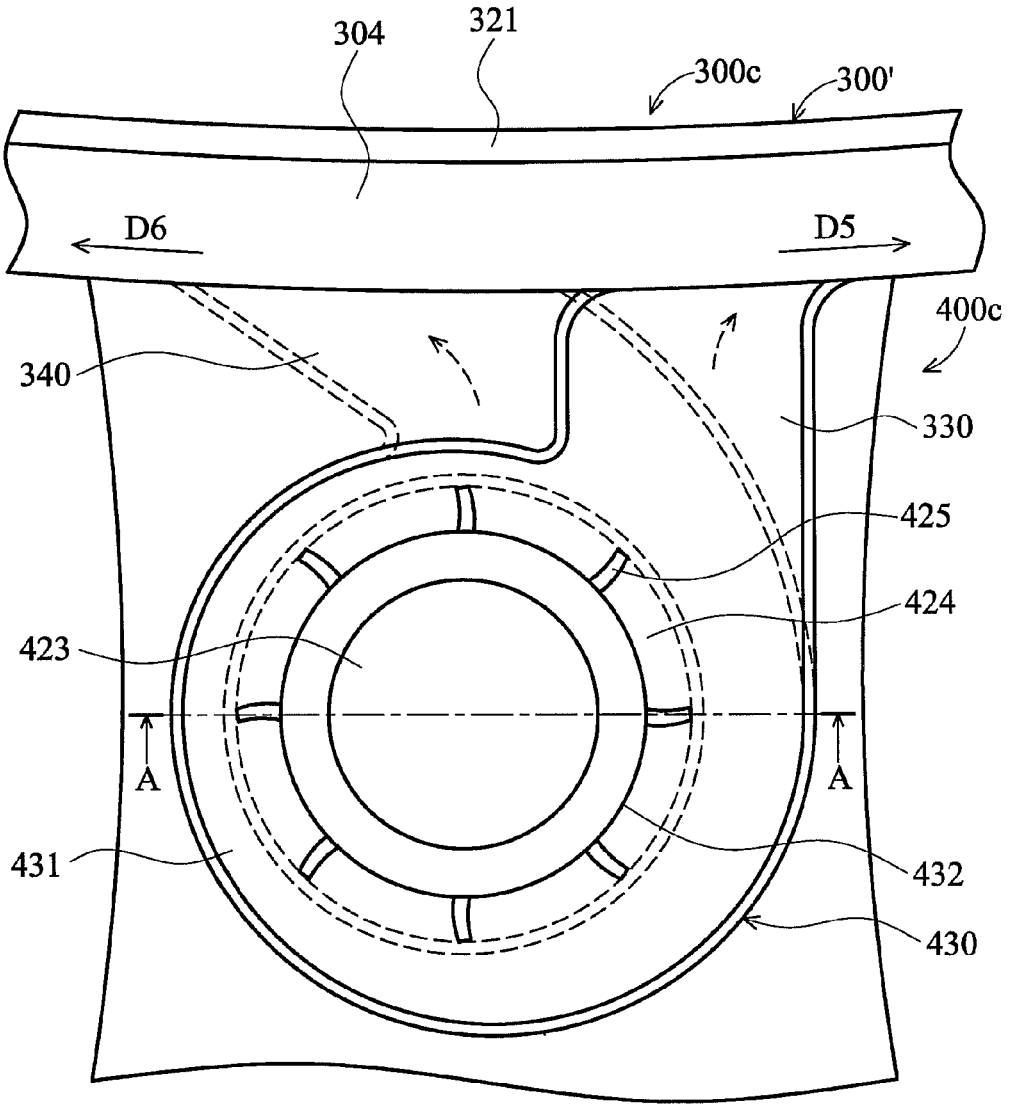
FIG. 7 is a schematic diagram of the fan assembly of the fourth embodiment of the invention.
Figure 8:
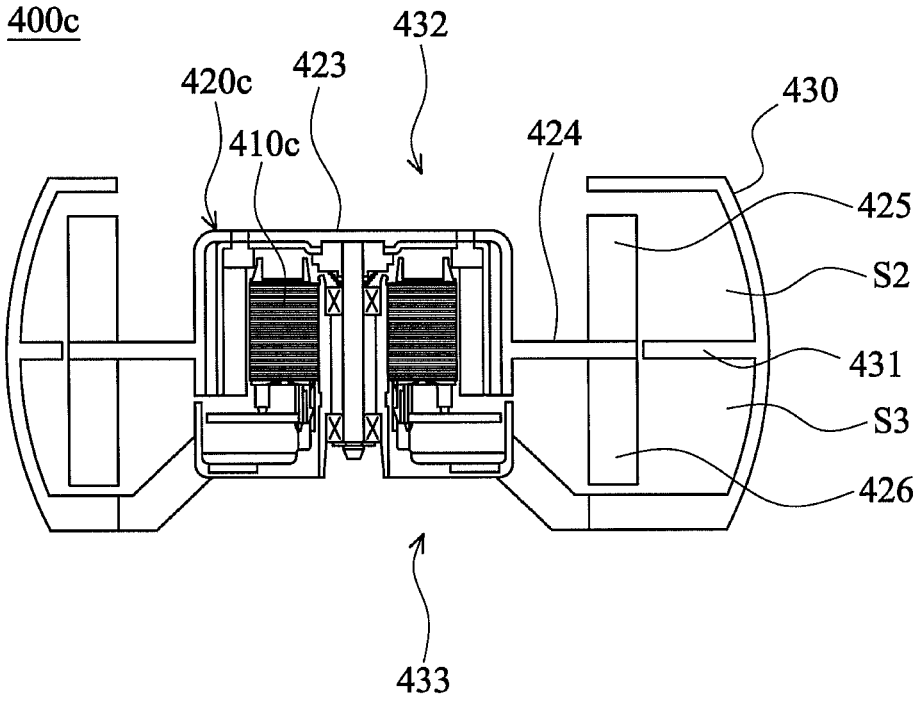
FIG. 8 is a cross-sectional view along the line AA of FIG. 7.

Please refer to FIGS. 7 and 8. FIG. 7 is a schematic diagram of the fan assembly of the fourth embodiment of the invention. FIG. 8 is a cross-sectional view along the line AA of FIG. 7. The difference between the fourth embodiment and the first embodiment is described below. A channel structure 300*c* includes a first guide channel 330 and a second guide channel 340. The first guide channel 330 and the second guide channel 340 are adjacent to a centrifugal fan 400*c*, and guide the airflow generated by the centrifugal fan 400*c* to flow into the flow channel 304 along the radial direction. The airflow guiding direction of the first guide channel 330 is different from that of the second guide channel 340. The centrifugal fan 400*c* further includes a fan case 430. The fan case 430 has a separator 431 therein. The inside of the fan case 430 is divided into a first space S2 and a second space S3 by the separator 431. The fan case 430 also has a first flow inlet 432 and a second flow inlet 433. The first flow inlet 432 is communicated with the first space S2. The second flow inlet 433 is communicated with the second space S3. The impeller 420 is disposed in the fan case 430 and generates airflow.

In the embodiment, an impeller 420*c* includes a hub 423, a connection element 424, a plurality of first blades 425, and a plurality of second blades 426. A motor 410*c* is disposed in the hub 420*c*. The first blades 425 and the second blades 426 are disposed around the hub 423. One side of the hub 423 is close to the first flow inlet 432. The other side of the hub 423 is close to the second flow inlet 433. The connection element 424 is disk-shaped. An inner end of the connection element 424 is connected to the hub 423 and an outer end of the connection element 424 is connected to the first blades 425 and the second blades 426. The first blades 425 and the second blades 426 are disposed on two opposite sides of the connection element 424, respectively. Namely, the connection element 424 is disposed between the first blades 425 and the second blades 426. The first flow inlet 432 is close to the first blades 425, and the second flow inlet 433 is close to the second blades 426.

The inside of the fan case 430 is divided into the first space S2 and the second space S3 by the connection element 424 and the separator 431. The separator 431 can further separate the first guide channel 330 from the second guide channel 340. Moreover, the first blades 425 are located at the first space S2 and correspond to the first guide channel 330. The second blades 426 are located at the second space S3 and correspond to the second guide channel 340. The airflow generated by the first blades 425 and the second blades 426 flows to the first space S2 as a first airflow, and flows to the second space S3 as a second airflow.

The first guide channel 330 is communicated with the first space S2 and the flow channel 304, and the second guide channel 340 is communicated with the second space S3 and the flow channel 304. The first guide channel 330 and the second guide channel 340 are crossed in an inlet direction, which can be the axial direction, of the centrifugal fan 400*c*. Namely, the first airflow flows into the flow channel 304 via the first guide channel 330 so that the first airflow is guided to flow along a first direction D5. The second airflow flows into the flow channel 304 via the second guide channel 340 so that the second airflow is guided to flow along a second direction D6. The second direction D6 is different from the first direction D5. Thus, the speed of the airflow generated by the centrifugal fan 400*c* can be increased. Because the flow channel 304 is an annular structure, the first direction D5 may be a counter clockwise direction and the second direction D6 may be a clockwise direction. Alternatively, the first direction D5 may be a clockwise direction, and the second direction D6 may be a counter clockwise.

Figure 9:
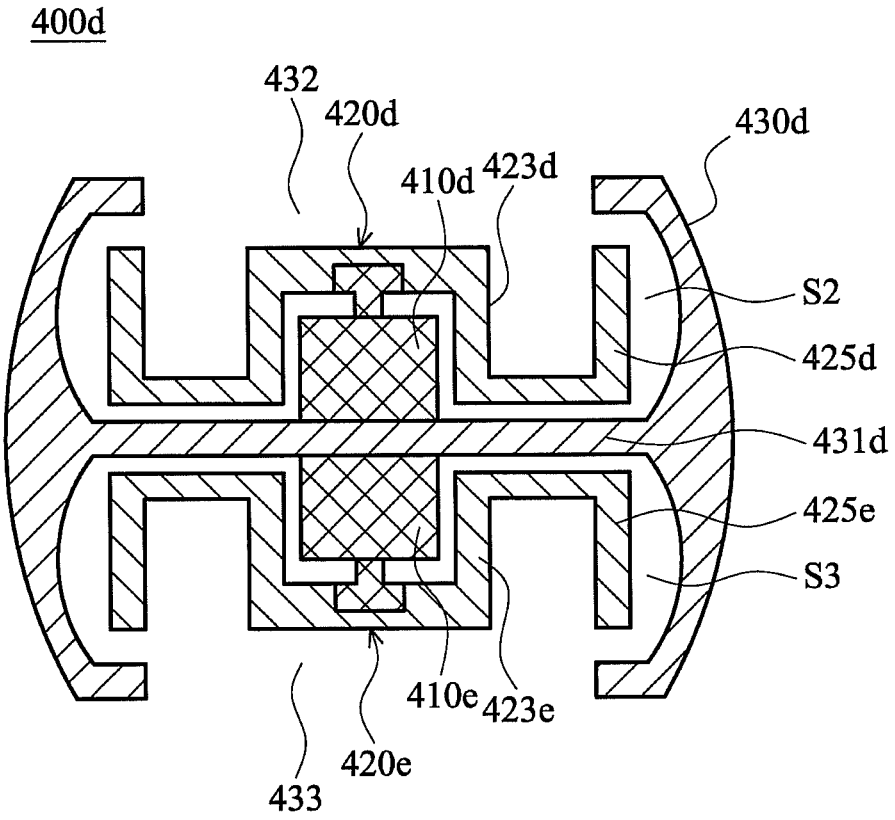
FIG. 9 is a schematic diagram of the fan assembly of the fifth embodiment of the invention.

Please refer to FIG. 9, which is a schematic diagram of the fan assembly of the fifth embodiment of the invention. The difference between the fifth embodiment and the fourth embodiment is described below. A fan case 430*d* is separated into a first space S2 and a second space S3 only by a separator 431*d*. A centrifugal fan 400*d* includes a first motor 410*d* and a first impeller 420*d* corresponding to the first guide channel 330 (shown in FIG. 7). The centrifugal fan 400*d* further includes a second motor 410*e* and a second impeller 420*e* corresponding to the second guide channel 340 (shown in FIG. 7). The first motor 410*d* and the second motor 410*e* are separated by the separator 431*d*, and a first hub 423*d* and a second hub 423*d* are separated by the separator 431*d*, too. The first impeller 420*d* and the second impeller 420*e* are disposed in the first space S2 and the second space S3. The first impeller 420*d* includes the first hub 423*d* and a plurality of first blades 425*d*. The second impeller 420*e* includes the second hub 423*e* and a plurality of second blades 425*e*. The first motor 410*d* and the second motor 410*e* are disposed in the first hub 423*d* and the second hub 423*e*, respectively. The first blades 425*d* and the second blades 425*e* are disposed around the first hub 423*d* and the second hub 423*e*, respectively. The first impeller 420*d* and the second impeller 420*e* are rotated in opposite directions.

Accordingly, by the separated channels, the airflow can be guided into the flow channels in opposite directions by the centrifugal fans of the fourth and the fifth embodiments. The airflow can be guided more efficiently in contrast to the prior art, wherein the airflow flows to the flow channel in a single direction.

Figure 10:
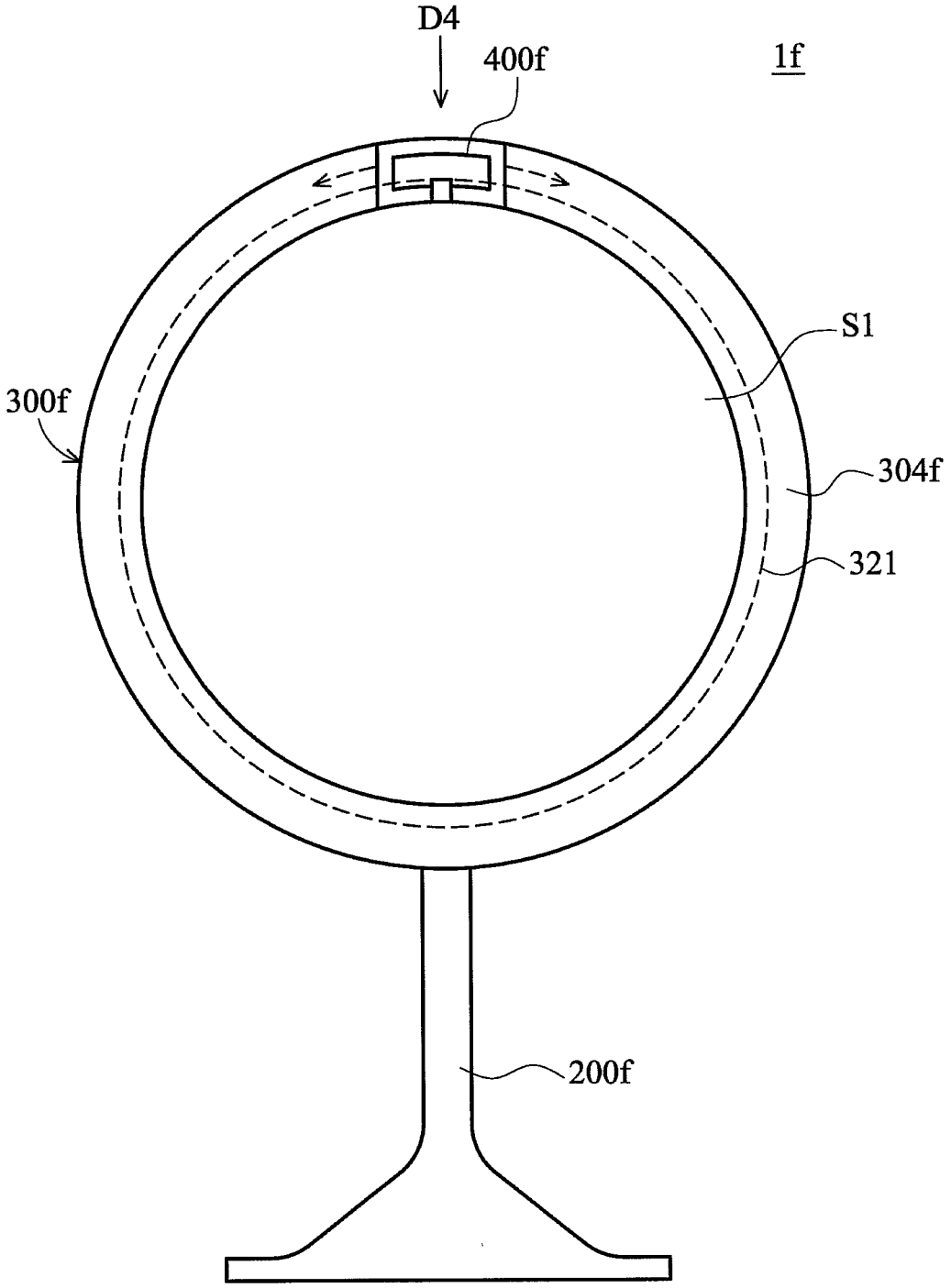
FIG. 10 is a schematic diagram of the fan assembly of the sixth embodiment of the invention.

Please refer to FIG. 10, which is a schematic diagram of a fan assembly if of the sixth embodiment of the invention. The difference between the sixth embodiment and the first embodiment is described below. A centrifugal fan 400*f* is disposed at the other end, opposite to a base 200*f*, of a channel structure 300*f*. The centrifugal fan 400*f* is disposed at the top side of the channel structure 300*f*. The centrifugal fan 400*f* can be disposed horizontally, so the axial direction D4 can be vertically downward, as shown in FIG. 10. Therefore, the centrifugal fan 400*f* can be disposed at a high position to prevent children from touching. Furthermore, a flow channel 304*f* is an annular structure in a C shape, and the two opposite sides of the centrifugal fan 400*f* are close to the two ends of the flow channel 304*f*. Namely, the centrifugal fan 400*f* generates the airflow to the two ends of the flow channel 304*f*. Therefore, the exhaust efficiency can be further improved.

Figure 11:
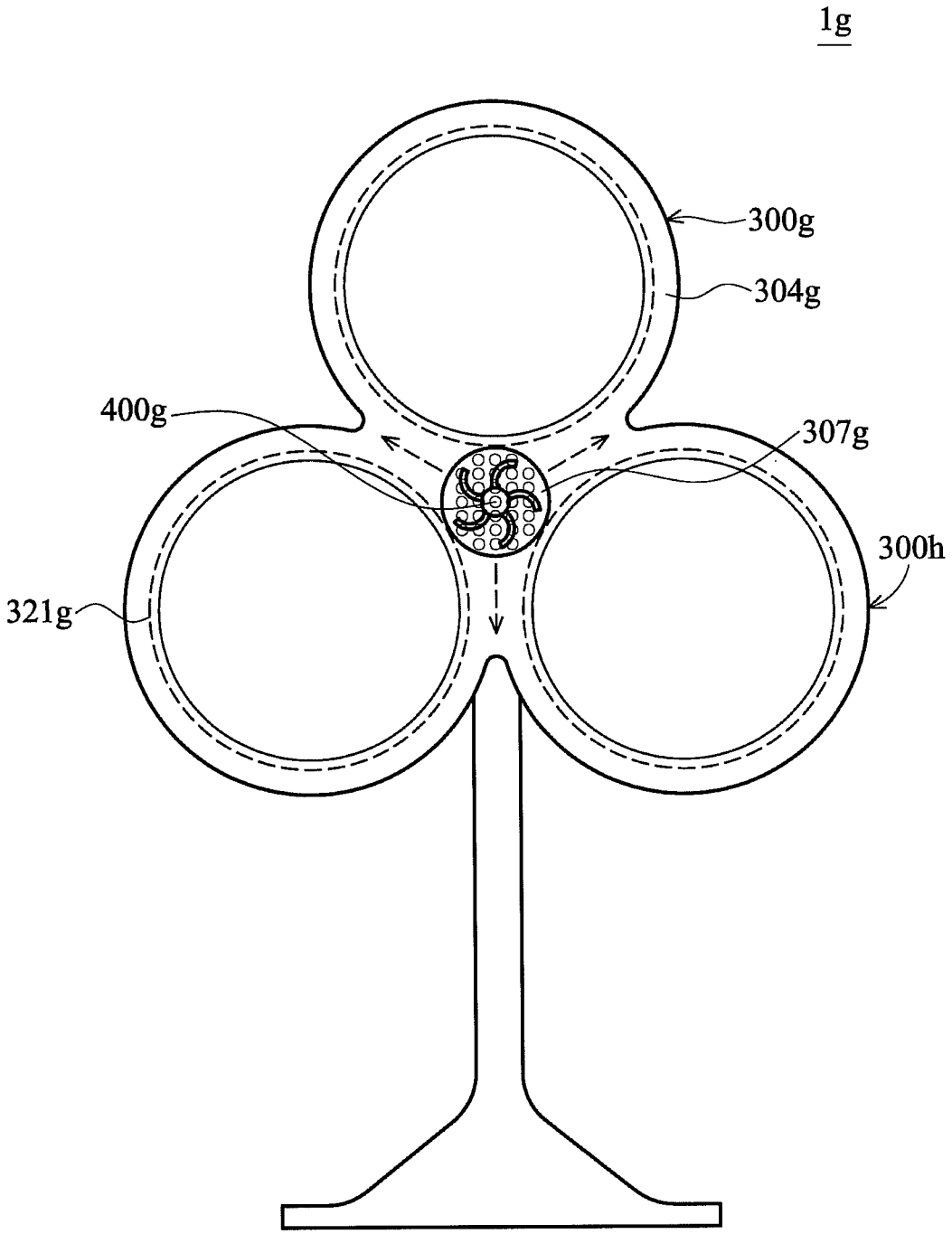
FIG. 11 is a schematic diagram of the fan assembly of the seventh embodiment of the invention.

Please refer to FIG. 11, which is a schematic diagram of a fan assembly 1*g* of the seventh embodiment of the invention. The difference between the seventh embodiment and the first embodiment is described below. A channel structure 300*g* is constituted by a plurality of annular structures 300*h*. A centrifugal fan 400*g* is disposed on the connecting portion of the annular structures 300*h*. The annular structures 300*h* are disposed around the centrifugal fan 400*g*. The connecting portion of the annular structures 300*h* has an accommodating space 307*g*. The accommodating space 307*g* is communicated with a plurality of flow channels 304*g* of the annular structures 300*h*. The centrifugal fan 400*g* is disposed in the accommodating space 307*g*. The annular structures 300*h* are disposed at the same plane or at different planes. When the annular structures 300*h* are disposed at the same plane, the area of a slit 321*g* is increased and the area of the cross section of all of the flow channels 304*g* is increased. Thus, the airflow of the fan assembly 1*g* can be increased by raising the rotating speed of the centrifugal fan 400*g*. When the annular structures 300*h* are disposed at different planes, the airflow of the fan assembly 1*g* can be increased and the airflow can flow in different directions. Thus, the flowing area of the airflow can be increased.

Figure 12:
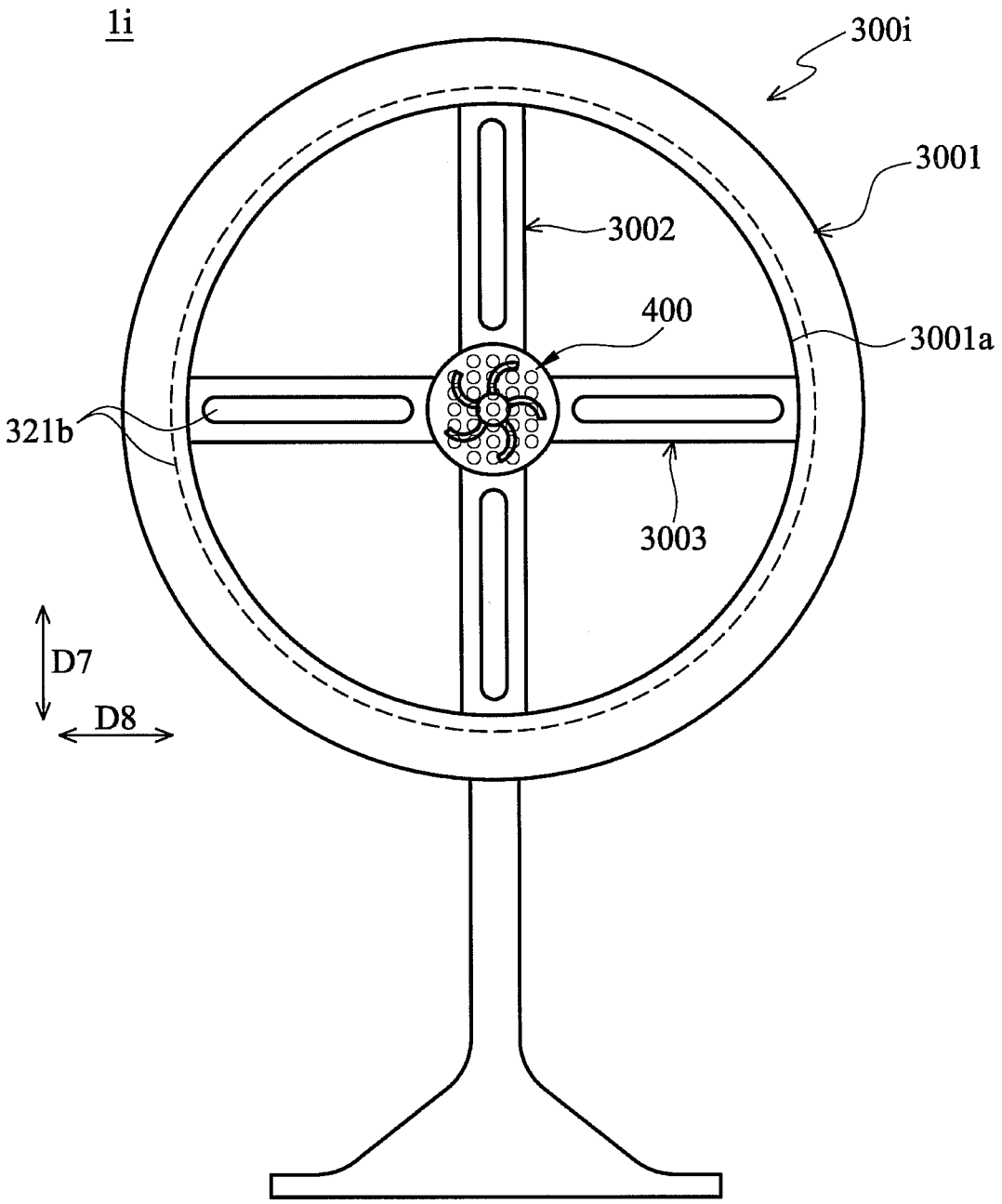
FIG. 12 is a schematic diagram of the fan assembly of the eighth embodiment of the invention.

Please refer to FIG. 12, which is a schematic view of a fan assembly 1*i* of the eighth embodiment of the invention. The difference between the eighth embodiment and the seventh embodiment is described below. The channel structure 300*i* includes an annular structure 3001 and a plurality of guide structures 3002, and 3003. The guide structures 3002 and 3003 are connected to the inner annular surface 3001*a* of the annular structure 3001. A centrifugal fan 400*i* is disposed on a jointing portion of the guide structures 3002 and 3003 at the center of the annular structure 3001. The guide structures 3002 can be extended along a longitudinal direction D7, and the guide structures 3003 can be extended along a transverse direction D8. The extending path of the guide structures 3002 and 3003 can be combined or separated. The slit 321*i* may be extended along the extending path of the guide structures 3002, and 3003.

In conclusion, since the invention utilizes the centrifugal fan and the improved channel structure, the space between the blade of the centrifugal fan and the flow channel will not be blocked by any component, such as a motor. In the invention, the airflow generated by the centrifugal fan can be guided by the guide channels directly without any bended path and may not be blocked by the motor as the prior art. The guide channel does not have to bend because of components such as a motor, and thus the airflow can flow smoothly. Moreover, the speed of the airflow generated by the centrifugal fan can be increased due to the guide channels of the invention. Preferably, the first and the second guide channels of the invention are stacked to each other, and thus the airflow can be guided to the flow channel in clockwise and counterclockwise directions respectively by the first and the second guide channels. Compared with the prior art wherein the airflow can be transmitted to the annular nozzle only in a single direction, the airflow of the invention can be transmitted more efficiently in two opposite directions.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan assembly, comprising:

a channel structure comprising:

a housing comprising an accommodating space and a flow channel; and at least one slit disposed along the flow channel, wherein the flow channel is communicated with an outside of the housing via the slit; and a centrifugal fan disposed in the accommodating space, drawing air along an axial direction of the centrifugal fan and generating an airflow to flow into the flow channel along a radial direction of the centrifugal fan, wherein the airflow flows out from the slit to the outside of the housing, wherein the channel structure comprises at least one guide channel adjacent to the centrifugal fan, and the guide channel guides the airflow generated by the centrifugal fan to enter the flow channel along the radial direction, and wherein the guide channel comprises a first guide channel and a second guide channel, and the airflow guided by the first guide channel flows along a first direction, the airflow guided by the second guide channel flows along a second direction, and the first direction is different from the second direction.

2. The fan assembly as claimed in claim 1, wherein the housing comprises at least one air inlet corresponding to the centrifugal fan in the axial direction, and the centrifugal fan draws air from the outside of the housing via the air inlet along the axial direction.

3. The fan assembly as claimed in claim 1, wherein the channel structure comprises a separator, and the first guide channel and the second guide channel are separated by the separator, and the first guide channel and the second guide channel are crossed in the axial direction.

4. The fan assembly as claimed in claim 3, wherein the channel structure is substantially an annular structure, and the first guide channel guides the airflow to flow into the flow channel of the annular structure along a clockwise direction, and the second guide channel guides the airflow to flow into the flow channel of the annular structure along a counter clockwise direction.

5. The fan assembly as claimed in claim 4, wherein the centrifugal fan comprises a motor, a hub, a plurality of first blades and a plurality of second blades, the motor is disposed in the hub, and the first blades and the second blades are disposed around the hub corresponding to the first guide channel and the second guide channel, respectively.

6. The fan assembly as claimed in claim 5, wherein the centrifugal fan further comprises a connection element in the shape of a disk, and the connection element is connected to the hub and the first and second blades, and the connection element is disposed between the first and second blades.

7. The fan assembly as claimed in claim 6, wherein the centrifugal fan comprises a first motor, a first hub, a plurality of first blades, a second motor, a second hub, and a plurality of second blades, the first motor, the first hub and the plurality of first blades correspond to the first guide channel, the second motor, the second hub and the second blades correspond to the second guide channel, the first and second motors are disposed in the first and second hubs, respectively, and the first and second blades are disposed around the first and second hubs, respectively.

8. The fan assembly as claimed in claim 7, wherein the first and second motors are separated by the separator.

9. The fan assembly as claimed in claim 1, wherein the flow channel comprises a channel portion and a gradually narrowed terminal portion.

10. The fan assembly as claimed in claim 9, wherein the terminal portion is gradually narrowed from an end of the terminal portion to an another end of the terminal portion, and the slit is disposed on an edge of the terminal portion away from channel portion.

11. The fan assembly as claimed in claim 9, wherein a cross section of the channel portion is substantially in a rectangular shape.

12. The fan assembly as claimed in claim 9, wherein a cross section of the flow channel is substantially in a winged shape, and a cross section of the channel portion is substantially in an arc shape.

13. The fan assembly as claimed in claim 9, wherein a cross section of the terminal portion is substantially in a V shape.

14. The fan assembly as claimed in claim 9, wherein the slit is disposed on the channel portion, and the housing has an overlapped part parallel to a flowing direction of the airflow adjacent to the slit.

15. The fan assembly as claimed in claim 9, wherein the housing has an inner side wall adjacent to the flow channel, and a cross section of the inner side wall is substantially parallel to the flow direction and straightly extended.

16. The fan assembly as claimed in claim 1, wherein the channel structure further comprises a slit channel communicated with the slit, and the housing has a first inner wall and a second inner wall adjacent to the flow channel, wherein the first inner wall and the second inner wall are substantially parallel to the flow direction and overlapped to each other, and the slit channel is formed at an overlapped part of the first inner wall and the second inner wall.

17. The fan assembly as claimed in claim 1, wherein the channel structure is substantially an annular structure, and an inner side of the annular structure has an air space, and the slit is extended around the inner side of the annular structure and the air space.

18. The fan assembly as claimed in claim 1, further comprising a base, wherein the channel structure is supported by the base.

19. The fan assembly as claimed in claim 1, wherein the centrifugal fan is disposed at an end of the channel structure adjacent to the base, or at an another end of the channel structure opposite to the base.

20. The fan assembly as claimed in claim 1, wherein the channel structure comprises a plurality of annular structures, and the centrifugal fan is disposed at a connecting portion of the annular structures.

21. The fan assembly as claimed in claim 1, wherein the channel structure comprises an annular structure and a plurality of guide structures, and the guide structures are connected to an inner annular surface of the annular structure, and the centrifugal fan is disposed on a connecting portion of the guide structure and located at the center of the annular structure.

22. The fan assembly as claimed in claim 21, wherein the guide structures comprise a first guide structure along a longitudinal direction and a second guide structure along a transverse direction.

23. The fan assembly as claimed in claim 1, wherein the channel structure is substantially an annular structure, and the annular structure has an air space therein, wherein the air space has an intake side and an exhaust side, and the airflow flows out from the slit to the outside of the housing to enable air in the air space to move from the intake side to the exhaust side.

24. A fan assembly, comprising:

a channel structure comprising:

a housing comprising an accommodating space and a flow channel; and at least one slit disposed along the flow channel, wherein the flow channel is communicated with an outside of the housing via the slit; and a centrifugal fan disposed in the accommodating space, drawing air along an axial direction of the centrifugal fan and generating an airflow to flow into the flow channel along a radial direction of the centrifugal fan, wherein the airflow flows out from the slit to the outside of the housing, wherein the channel structure comprises a plurality of annular structures, and the centrifugal fan is disposed at a connecting portion of the annular structures.

25. The fan assembly as claimed in claim 24, wherein the housing comprises at least one air inlet corresponding to the centrifugal fan in the axial direction, and the centrifugal fan draws air from the outside of the housing via the air inlet along the axial direction.

26. The fan assembly as claimed in claim 24, wherein the flow channel comprises a channel portion and a gradually narrowed terminal portion.

27. The fan assembly as claimed in claim 26, wherein the terminal portion is gradually narrowed from an end of the terminal portion to an another end of the terminal portion, and the slit is disposed on an edge of the terminal portion away from channel portion.

28. The fan assembly as claimed in claim 26, wherein a cross section of the channel portion is substantially in a rectangular shape.

29. The fan assembly as claimed in claim 26, wherein a cross section of the flow channel is substantially in a winged shape, and a cross section of the channel portion is substantially in an arc shape.

30. The fan assembly as claimed in claim 26, wherein a cross section of the terminal portion is substantially in a V shape.

31. The fan assembly as claimed in claim 26, wherein the slit is disposed on the channel portion, and the housing has an overlapped part parallel to a flowing direction of the airflow adjacent to the slit.

32. The fan assembly as claimed in claim 26, wherein the housing has an inner side wall adjacent to the flow channel, and a cross section of the inner side wall is substantially parallel to the flow direction and straightly extended.

33. The fan assembly as claimed in claim 24, wherein the channel structure further comprises a slit channel communicated with the slit, and the housing has a first inner wall and a second inner wall adjacent to the flow channel, wherein the first inner wall and the second inner wall are substantially parallel to the flow direction and overlapped to each other, and the slit channel is formed at an overlapped part of the first inner wall and the second inner wall.

34. The fan assembly as claimed in claim 24, further comprising a base, wherein the channel structure is supported by the base.

* * * * *